United States Patent [19]

Rose

[11] 4,016,532

[45] Apr. 5, 1977

[54] EMERGENCY TRAFFIC CONTROL SYSTEM WITH SECURITY TRANSMISSION CODING

[76] Inventor: Levi L. Rose, P. O. Box 22, Posen, Ill. 60469

[22] Filed: Nov. 5, 1975

[21] Appl. No.: 629,150

[52] U.S. Cl. ..... 340/32; 343/225; 325/30

[51] Int. Cl.[2] ..... G08G 1/00

[58] Field of Search ..... 340/32; 343/225

[56] References Cited

UNITED STATES PATENTS

| | | | |
|---|---|---|---|
| 3,114,127 | 12/1963 | Ramsey | 340/32 |
| 3,247,482 | 4/1966 | Lesher | 340/32 |
| 3,906,348 | 9/1975 | Willmott | 343/225 |
| 3,939,465 | 2/1976 | Helton | 343/225 |

*Primary Examiner*—Thomas B. Habecker
*Attorney, Agent, or Firm*—McDougall, Hersh & Scott

[57] ABSTRACT

An emergency traffic control system is disclosed for use with emergency vehicles to control traffic signal lights. A coded transmitter employing frequency shift keying is provided in the emergency vehicle and upon actuation, transmits a coded signal to a traffic signal light which is provided with a receiver. Upon reception of a verified signal, the receiver causes the signal light to indicate a steady red in all directions. The emergency system further includes a test circuit for positively determining whether the traffic signal is under control of the emergency vehicle to prevent an accident if two emergency vehicles are simultaneously trying to control the same traffic signal light.

6 Claims, 4 Drawing Figures

TRANSMITTER

IMPED MATCH
MIXER AMP
GATE
GATE
OSC f1
OSC f2
R Q F.F. Q̄ CLK
÷16 CNTR Q3 Q4
÷16 CNTR Q2 Q4
÷16 CNTR Q1 Q2 Q3 Q4
10 KHb CLOCK
TIMER
TIMER
SHIFT REG. L Q1 Q2 Q3 Q4 Q5 Q6 CLK R
CODE SELECT SWITCH

EMERGENCY TRAFFIC CONTROL SYSTEM WITH SECURITY TRANSMISSION CODING

BACKGROUND OF THE INVENTION

This invention relates to the field of emergency traffic control equipment. More specifically, it relates to equipment for controlling traffic signals at city intersections so that emergency vehicles can quickly pass the intersection to respond to an emergency call.

Typically in prior art devices for this purpose a radio transmitter is provided in the emergency vehicle. A receiver is provided in the traffic signal light and, upon actuation of the transmitter, the traffic signal is controlled and, for example, a steady red signal in all directions is produced. This situation permits the emergency vehicle to rapidly pass the intersection. Examples of such prior devices are disclosed in the following U.S. Pat. Nos.: 2,903,674 to Schwab; 2,881,409 to Cook et al; 3,209,325 to Mentzer et al; and 3,257,641 to Campana et al.

In some of these devices provision is made for indicating that two emergency vehicles are simultaneously trying to control a traffic signal for the same intersection. In some cases this is indicated by an additional flashing light provided on the signal or the provision of a transmitter in the signal light to transmit a danger signal back to the emergency vehicle. Such methods of indicating a conflict in the control of the signal are not entirely satisfactory. In particular, the standard traffic control signals must be altered by the provision of a transmitter or outfitted with auxiliary beacons or flashing devices.

A further drawback of the cited references is the lack of a security code system to prevent operation of the traffic signals by radio equipment available to the public. Further in an urban environment stray electronic signals, as from paging systems, citizens band radios and the like, have a tendency to inadvertently actuate such systems. The patent to Cook et al partially recognizes this problem and employs a key and control tone signal. It is desirable, however, to provide a positive selectable transmission code system in order that positive control and security are maintained.

It is accordingly an object of the present invention to provide an emergency traffic control system which employs coded transmission, and which activates the traffic control signal only upon reception of the precise selected code.

It is a further object of the present invention to provide a traffic control system which has a positive means of indicating to an emergency vehicle that the intersection which it is desired to control is already under the control of another emergency vehicle or, alternatively, that the intersection is indeed under the control of a first driver.

It is a further object of the present invention to provide a traffic control signal system which does not require the addition of visual signaling devices or mechanical elements but which can be installed in existing traffic control systems.

Other objects and advantages of the invention will become apparent from the remaining portion of the specification.

DETAILED DESCRIPTION

Figure 1:
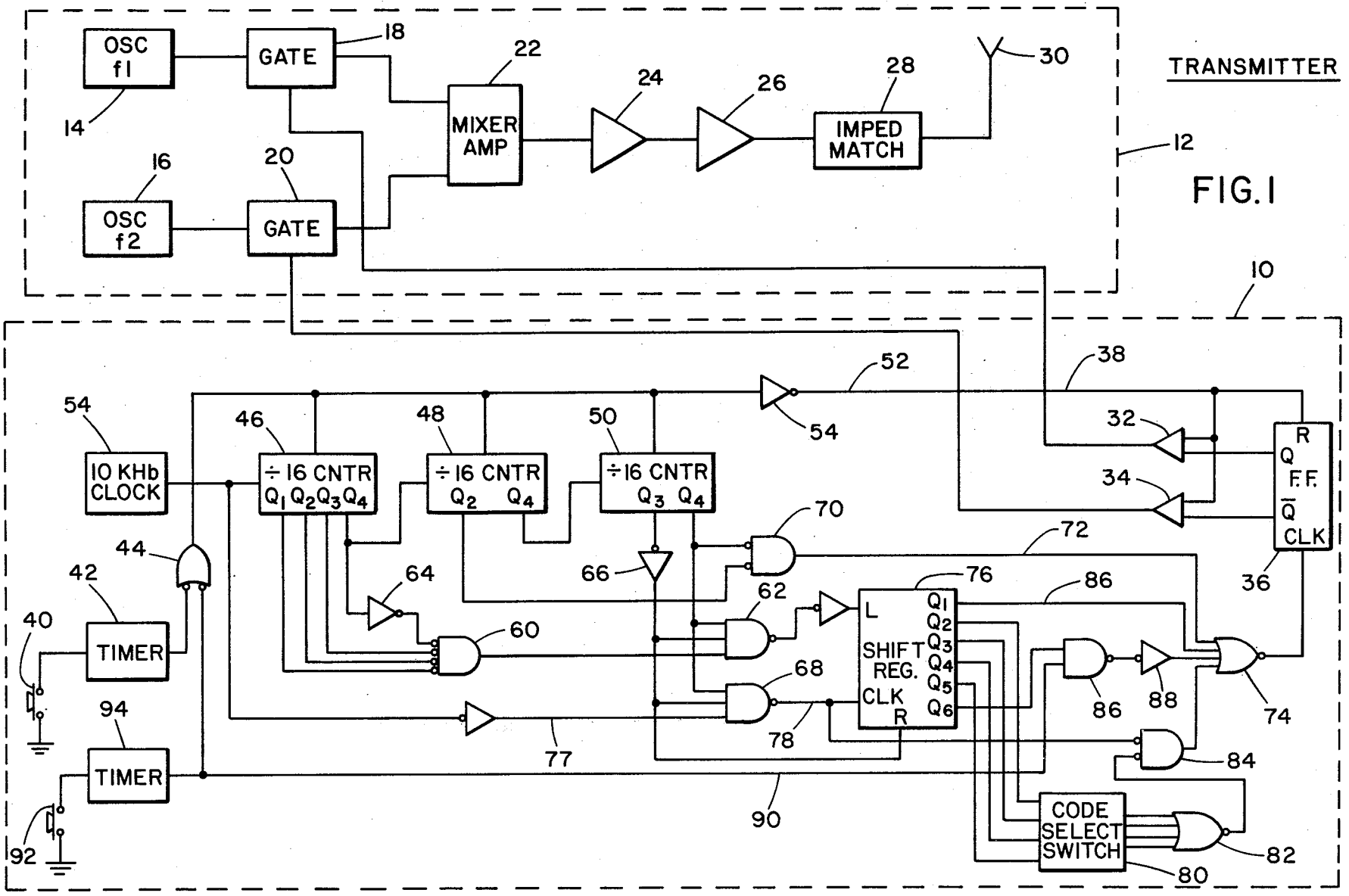
FIG. 1 is a schematic diagram of the transmitter circuit of the invention.

Referring now to FIG. 1, the transmitter according to the present invention is illustrated. The transmitter is located in the emergency vehicle, preferably within reach of the driver so that as an emergency vehicle approaches an intersection which it is desired to control, the driver can actuate the transmitter to begin the sequence for causing the traffic control signal to turn red.

The transmitter is formed of two principal sections, namely, a code and gating section 10, and a transmission section 12. Considering first the transmission section 12, there are provided two oscillators 14 and 16 connected via gates 18 and 20 to the input of a mixer amplifier 22. The oscillators 14 and 16 are radio frequency oscillators, oscillator 14 having a frequency F1, oscillator 16 having a frequency F2. Preferably the frequencies F1 and F2 are centered around 30 megahertz, F1 being slightly below and F2 being slightly above. This frequency is preferable because the propagation characteristics are favorable in all weather conditions.

The gates 18 and 20 are controlled by the code and gating section 10 whereby only one of the frequencies passes through to the mixer amplifier 22 at a given time. The method of transmission employed is known in the art as Frequency Shift Keying (FSK). Frequency Shift Keying employs two RF oscillators, and switches alternatively from one to the other in response to the receipt of a selected gating code. In the receiver, a change in frequency is indicative of a logical one, while a constant frequency is indicative of a logical zero. By selecting when frequency changes occur and when frequency transmission remains constant, a multibit pulse code can be produced much like a safe combination. This is described in greater detail in connection with the code and gating circuit 10. By employing Frequency Shift Keying in conjunction with a preselected code in both the transmitter and the receiver, a great deal of security is obtained in the system, rendering it immune to stray radiation from the multiple sources of electronic signals in today's environment.

Figure 3:
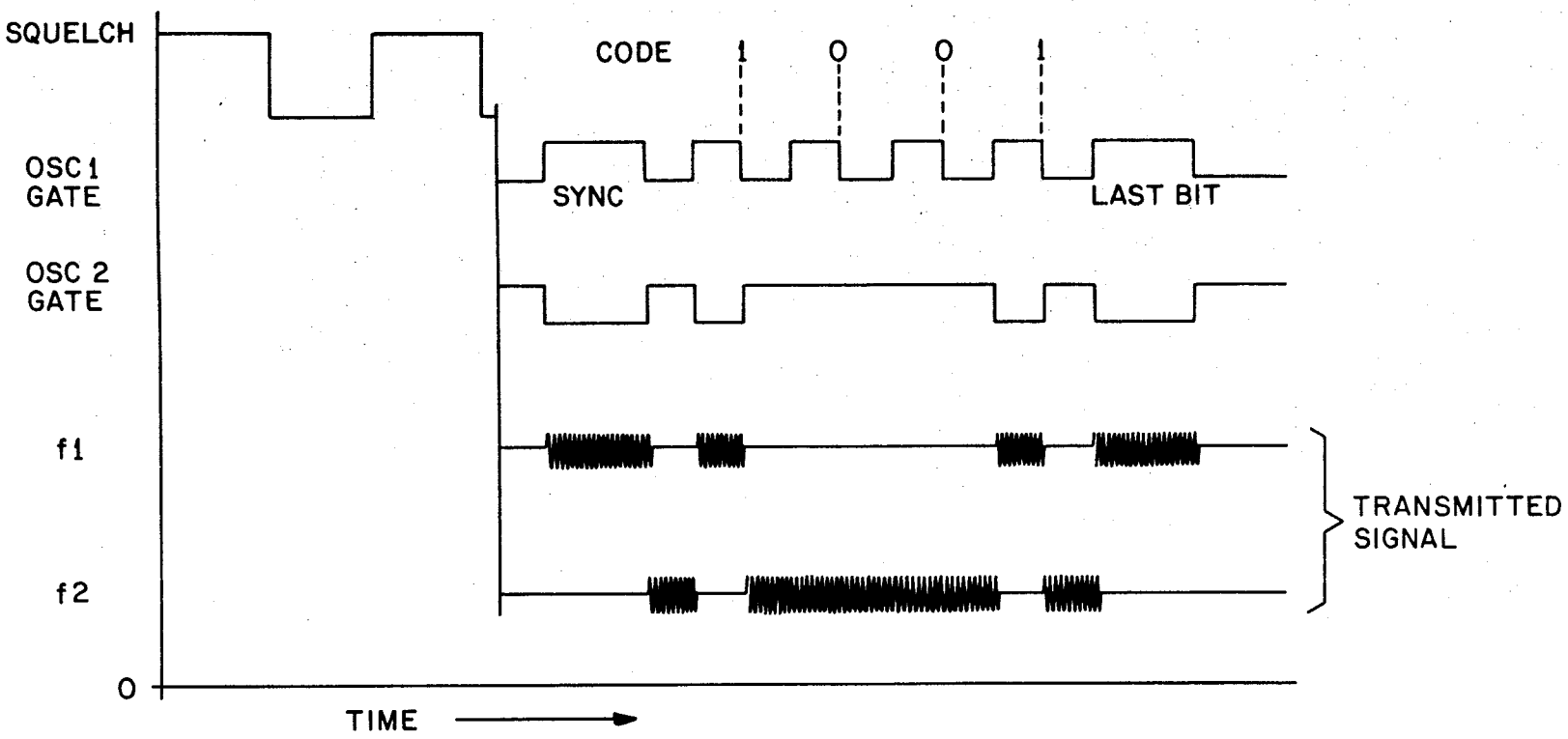
FIG. 3 is a waveform diagram illustrating the signals generated by the FIG. 1 circuit.

The oscillators 14 and 16 are gated alternately to the output of the transmission section 12 via gates 18 and 20, mixer amplifier 22, amplifiers 24 and 26, impedance matching circuit 28, and antenna 30. The amplifiers, impedance matching circuit, and the antenna are standard elements and require no specific consideration here. As illustrated in FIG. 3, the output from the transmission section 12 will therefore contain two frequencies, F1 and F2, depending upon which oscillator is gated to the output.

Considering the code and gating circuit 10, it will be seen that gates 18 and 20 are connected via driver amplifiers 32 and 34 to the outputs of a flipflop 36. Thus, depending upon the state of the flipflop 36, either gate 18 or gate 20 will be enabled while the other gate is disabled. When the transmitter is not in operation, both gates are disabled due to the presence of a clear signal at the input to the driver amplifiers 32 and 34 on line 38.

The operation and function of the code and gating circuit is to produce a preselected code pattern for driving flipflop 36 and thereby to control the gating of the frequencies F1 and F2 to the output of the transmitter. Also included within the code and gating circuit is a test circuit to positively indicate to the driver of the emergency vehicle that he is in control of the intersection traffic signal.

The transmitter unit is actuated by manual operation of switch 40, which actuates a timer 42. Timer 42 times the operation of the circuit to transmit a burst of pulse code for a selected period. The timer can be set to a desired time interval, and preferably this interval is on the order of 400 microseconds. Initiating operation of the timer 42 is effective for removing the reset potential through negative input or gate 44 applied to the reset inputs of divide-by-16 counters 46, 48 and 50. It also is effective for removing the inhibit signal from the driver amplifiers 32 and 34 via line 52 and inverting amplifier 54. Removing the inhibit signal from the driver amplifiers immediately begins gating one of the oscillators 14 or 16 to the output of the transmitter.

The code and gating section includes a 10 K Hz clock 54 which is used for driving the counters 46, 48 and 50 as well as providing clock pulses to other sections of the circuit to be described. The counters 46, 48 and 50 are standard counters such as are available from Fairchild Semiconductor; for example, No. 9316. The serially connected counters 46, 48, and 50 begin counting, each producing four outputs Q1 through Q4. The output Q4 of counter 46 is provided as a carry input to counter 48, and similarly the Q4 output of counter 48 is provided as a carry input to counter 50.

The outputs of the counters 46, 48, and 50 are utilized to generate a squelch signal, a sync pulse, a four bit pulse code, and a final check pulse (see FIG. 3).

Specifically, the Q1 through Q4 outputs of counter 46 are gated through a negative input AND gate 60, the output of which is provided as one input to three input AND gate 62. The remaining two inputs to gate 62 are provided from the Q3 and Q4 outputs of counter 50. In order to accommodate negative logic transitions, inverters 64 and 66 are utilized on the Q4 output of counter 46 and the Q3 output of counter 50. Logic gates 68 and 70 complete the logic array.

Considering logic gate 70, it will be seen that the inputs to this gate are Q2 from counter 48 and Q4 from counter 50. When Q4 of counter 50 and Q2 of counter 48 are low, gate 70 is operative and an output is produced on line 72. This output is provided as one of four inputs to NOR gate 74, the output of which is provided to the clock input of flipflop 36. The output on line 72 produces the squelch signal which is transmitted as long as gate 70 is operating, which is approximately 200 milliseconds. After the 200 milliseconds, gate 70 cuts off when Q4 of counter 50 goes high.

The squelch signal, illustrated in FIG. 3, is utilized as a preliminary signal and is recognized by the receiver as a prerequisite for reception of the subsequent coded signal. The squelch is picked up by a squelch detector in the receiver to be described. The squelch signal is merely a square wave having a frequency on the order of 78 hertz controlling the drivers and gates 18 and 20 for alternating output frequencies F1 and F2 from the transmission section 12.

As the count progresses on counters 46, 48, and 50, the squelch signal is superseded by a synchronizing pulse produced by gating through NAND gate 62. Gate 62 is enabled when Q4 of counter 50 goes high and Q3 is low. This condition, in conjunction with the input from gate 60, operates gate 62 effective for loading each successive pulse into shift register 76. The shift register functions to shift the loaded input pulse from its Q1 output sequentially to its Q2, Q3, Q4, Q5, and Q6 outputs every time a clock signal is received on line 78 from gate 68. The gating of the clock input is controlled by the counters and by line 77 directly from the clock 54.

To restate the operation of the shift register 76, the outputs Q3 and Q4 of counter 50 control operation of the gate 68 in conjunction with the clock 54. Gate 62 loads the shift register with a pulse while gate 68 clocks the pulse through the shift register. As the pulse is clocked through the shift register, the register outputs change state from low to high at a rate determined by the clock frequency on line 78.

The outputs Q2 through Q5 of the shift register 76 are coupled to a code selector switch 80. This switch is preferably a four-deck rotary switch well known in the art and by which it is possible to select a desired combination of shift register outputs to produce a desired binary code.

The outputs of the code selector switch 80 are provided to a four input OR gate 82 the output of which is provided to a negative input AND gate 84 the other input of the AND gate being the clock pulse produced on line 78. It will be noted that the Q1 output of shift register 76 is not provided to the code selector switch 80 but rather is provided directly to NOR gate 74 on line 86. Thus, the pulse loaded into the shift register 76 is immediately provided to the flipflop 36 via NOR gate 74.

This gating of the pulse to the flipflop via line 86 occurs after the squelch signal has been produced and the pulse thus provided is utilized for synchronization of the receiver. Hereafter this pulse will be referred to as the sync pulse.

After production of the sync pulse the subsequent shifting of the signal loaded into shift register 76 produces selectable outputs through the code selector switch 80, NOR gate 82, AND gate 84 and NOR gate 74. Depending upon the position of the rotary switches any one of 16 possible binary code patterns for four bits are possible. That is, the Q2, 3, 4 and 5 inputs to the selector switch 80 can be gated through switch 80 or not as desired.

In FIG. 3 the output produced for the code 1001 is illustrated. After the squelch and sync signals are transmitted, further operation of the flipflop 36 is controlled by the output from the selector switch 80. If shift register output is blocked by the switch then whichever oscillator is gated to the output of the transmission section continues to be transmitted, while if the code selector switch 80 produces an output flipflop 36 causes a frequency shift.

After transmission of the four selectable code bits a final check bit is transmitted and this bit is produced from the Q6 output of the shift register 76 via NAND gate 86, inverter 88 and NOR gate 74. It should be noted that NAND gate 86 has an additional input thereto from line 90 which input is normally high so that operation of gate 86 is controlled by the output of Q6 and will produce the check bit. As will be described, however, in order to test the operation of the traffic control signal to positively determine it is being operated by a given emergency vehicle the check bit is inhibited from line 90 and the receiver section, to be described, detects the absence of the final check bit to initiate the test.

The test mode is initiated by manual actuation of a push button switch 92 operating a timer 94 substantially identical to timer 42 and which produces a similar sequence of operation as just described. It is noted, however, that operation of push button 92 rather than button 40 produces an inhibit signal on line 90 preventing gate 86 from passing the check bit to flipflop 36.

Summarizing the operation of the transmitter, it will be apparent that each time push button 40 is actuated, transmission begins. The transmission includes squelch signal followed by a sync bit and four selectable code bits followed by a final check bit. This information is utilized to gate the oscillators 14 and 16 to the transmitter output. At the receiver continued transmission of whichever frequency is present represents a binary 0 while a change in frequency represents a binary 1. By utilization of comparison circuits to verify the received code bits, it is possible to provide a highly secure emergency system and prevent unauthorized operation thereof.

Figure 2:
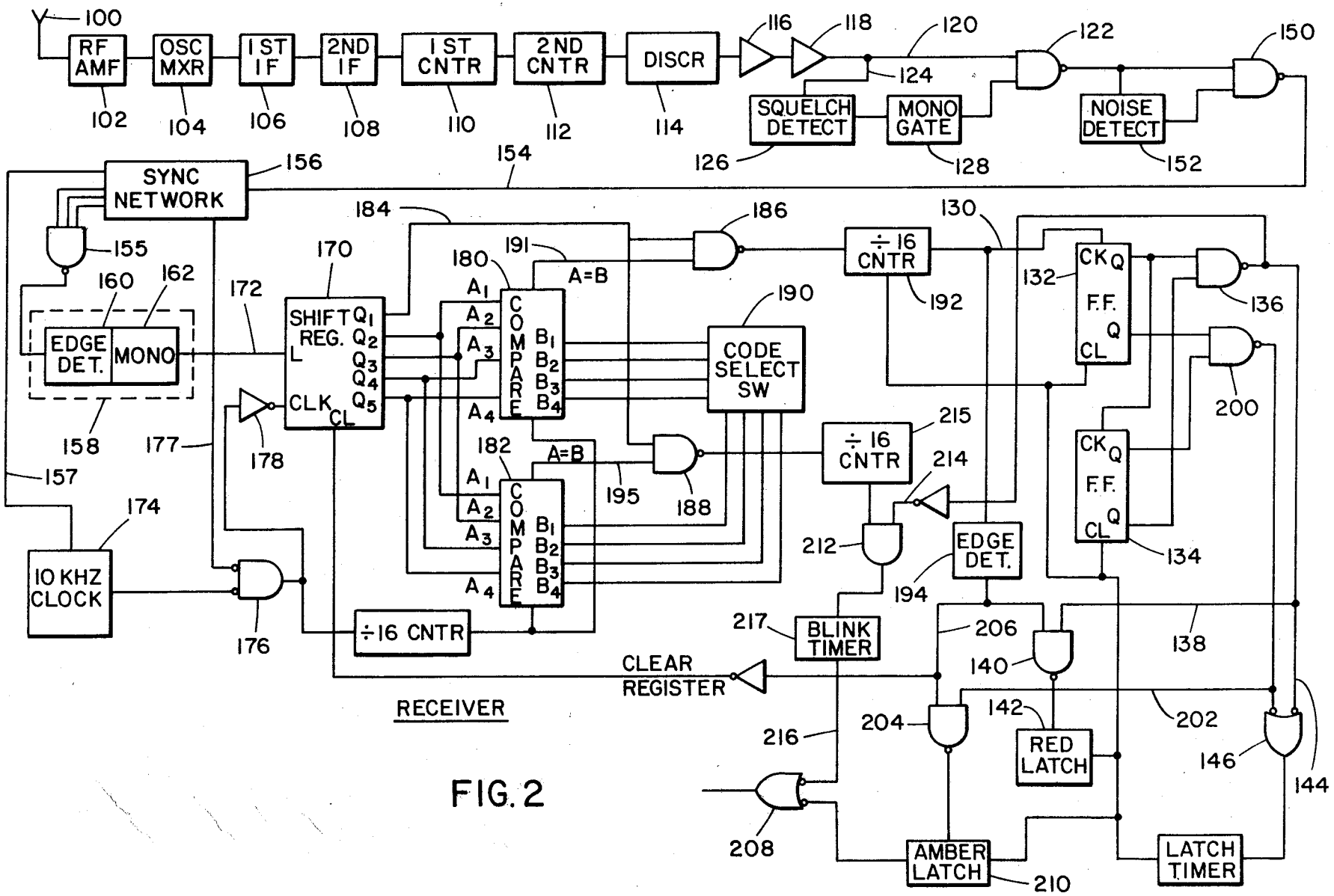
FIG. 2 is a schematic of the receiver circuit of the invention.

Referring now to FIG. 2, the code receiver and detection logic is illustrated. The receiver and detection logic preferably are formed from integrated circuit components. In such case the entire assembly may be of a size small enough to be placed in conventional traffic signal control boxes without the need for any significant mechanical modification thereto. The transmitted RF signals are received by antenna 100 designed for frequencies of approximately 30 MHz. The received signal is amplified in the RF amplifier 102 and then provided to oscillator mixer 104, and first and second intermediate frequency stages 106 and 108 in a manner well known in the art. In the oscillator mixer 104 the RF signal is hetero-dyned with a local oscillator signal and the resulting signal produced is a combination of the sum and difference frequencies.

The oscillator 104 is tuned so that the difference frequency is approximately 2 MHz and this is the intermediate frequency which is amplified by the amplifiers 106 and 108. Two stages of amplification are utilized to insure that the signal is of sufficient amplitude to drive a limiter 110 thereby to shape the signal and remove any amplitude variation. For a similar purpose, a second limiter 112 is provided.

From limiter 112 the signal passes to a discriminator 114, which is a tuned circuit having an S-curve transfer characteristic. The circuit is tuned to 2 MHz so that when the received signal is approximately 2 MHz the D.C. output from the discriminator is zero. When a frequency change is detected, i.e., from the frequency f1 to the frequency f2, the output of the discriminator 114 will change.

In this manner the discriminator functions to demodulate the received FSK signal to reproduce the original signal code generated by the code and gating circuit 10 to modulate the oscillators 14 and 16 of the transmission section of the transmitter. Thus, the output of the discriminator 114 will be a pulse train approximating the pulse train utilized to modulate the oscillators in the transmitter. The pulse train thus produced is amplified and shaped in amplifiers 116 and 118, respectively. The output of amplifier 118 then is the original squelch signal and code pattern produced by the code and gating section 10.

The output of amplifier 118 is provided via line 120 to NAND gate 122 and via lane 124 to squelch detector 126. The output of the squelch detector 126 is provided through a monostable vibrator 128 as a second input to the NAND gate 122. When the squelch signal is received, it is detected by the squelch detector. The squelch detector 126 is a phase-lock loop circuit tuned to the squelch signal frequency. Detection of the squelch signal by the squelch detector 126 will cause the squelch detector to produce an output to the monostable vibrator 128, thereby to enable NAND gate 122. This permits the pulse train from amplifier 118 to pass the gate 122. It will be apparent that no signal can be received by the detection portion of the receiver until a correct squelch signal has been detected, thereby to enable gate 122.

The output of the divide by 16 counter 192 is also provided via line 130 to a pair of serially connected flipflops 132 and 134. Flipflops 132 and 134 serve as counters, their count being indicative of the number of times a code signal has been detected. In turn, this indicates the number of times that the receiver detects the presence of a pulse train which is capable of actuating the traffic control signal into its emergency mode. When a code signal is first detected, flipflop 132 is set and the two flipflops thus indicate an output of binary one. This enables NAND gate 136 and via line 138, NAND gate 140 which controls red light latch 142. The output of NAND gate 136 via line 144 and negative input OR gate 146 also initiates operation of a cycle timer 148 which, after a preselected period of time, resets the red light latch 142 to return the operation of the traffic control signal to normal.

As will be apparent and as discussed hereafter, if a second squelch signal and code pulse train is received while in the emergency mode, the flipflop counters 132 and 134 will change count to binary 2, affecting the gating logic connected to their output. This indicates the presence of a second emergency vehicle attempting to control the same traffic control light.

Referring again to NAND gate 122, it will be apparent that once the squelch signal is received and detected, gate 122 is open, permitting the pulse train signals to enter the logic and detection portion of the receiver. From gate 122 the signals pass to NAND gate 150 and to a noise detector 152, which prevents noise from entering the circuit if such appears after the squelch detector permits gate 122 to open. If the noise detector 152 detects noise, gate 150 is disabled. In the absence of noise, detector 152 permits gate 150 to pass the pulse train to the logic section of the receiver on line 154.

The logic section of the receiver includes a sync network 156, various gating arrangements and comparators for comparing the received pulse train against a selected code. The sync network 156 is described hereafter in connection with FIG. 4. The sync network functions to detect the sync bit which immediately follows the squelch bits in the transmitted pulse train. When the sync bit is detected, the remaining pulse train is provided to the logic circuit via a pulse translator 158. Pulse translator 158 functions to restore the signal to its original state. That is, since the original pulse train generated in the code and gating section 10 of the transmitter is utilized to drive flipflop 36 in order to gate the oscillators 14 and 16, this produces a divide by 2 effect on the pulse train.

In the receiver, it is therefore necessary to in effect double the pulse train in order to restore the original pulse train signal. The pulse rate translator 158 receives the input pulse train and produces a pulse corresponding to each change of state of the pulse. That is, on the leading and trailing edge of each pulse, an output is produced by the translator 158. This is accomplished by using a leading and trailing edge detector 160, the input of which is provided to a monostable multivibrator 162 to produce pulses of a constant width and amplitude for operation of the code detecting section of the circuit. The output from the pulse translator 158 is provided to a shift register 170 via line 172.

Clock 174 is an oscillator running at approximately the same frequency as the clock 54 in the transmitter, preferably 10 K Hz. It is not critical that the clocks run at precisely the same frequency but they should be operating at substantially the same frequency. Clock 174 via NAND gate 176 and inverting amplifier 178 is effective for clocking the shift register 170 whereby the pulses loaded into the shift register on line 172 are clocked through shift register. The outputs Q2–Q5 of the shift register are provided to comparators 180 and 182 and, via line 184, the last bit is provided to NAND gates 186 and 188. The second input to gate 176 is provided from the sync network via line 177 in order to maintain proper clock phase relationship for shift register operation.

As the pulse train is loaded into shift register 170 and successively shifted therethrough, its output will be compared by comparators 180 and 182 against a code preset in a code selector switch 190 identical to code selector switch 80 in the transmitter. When the outputs of shift register 170 coincide with the pattern set in the code selector switch 190 an output signal is produced. Comparators 180 and 182 are each four bit comparators and thus when the input lines A1–A4 are exactly equal to the selector switch inputs B1–B4 an output is produced on line 191 in the case of comparator 180 and on line 195 in the case of comparator 182. In each case, this output is provided to a respective one of NAND gates 186 and 188. As will be apparent, gate 186 receives an input from comparator 180 when the code bits match the code set in the selector switch 190 while one bit is provided as a second input via line 184 directly to the gate 186. When the code matches the selected code at gate 186, an output is produced which is provided to a divide by 16 counter 192. Counter 192 produces an output for every 16 pulses received, thereby to assure that a minimum of 16 valid code bursts are received before the system will activate the red light latch 142.

After 16 valid code pulses have been received, the counter 192 produces an output pulse detected by edge detector 194 which, via NAND gate 140, operates red light latch 142. It will be recalled that NAND gate 140 had been enabled when the divide by 16 counter 192 activated flipflop 132 via line 130, providing an output signal on line 138. Once activated, the red light latch 142 changes the normal operation of the traffic control signals and causes a continuous red light to be displayed until the timer 148 times out and returns the latch 142 to its normal state. If no further signals are received after the timer 148 times out, normal operation of the traffic lights again begins.

As pointed out earlier in this specification, it is necessary to provide means for indicating to emergency vehicles approaching a given traffic signal that the intersection is being controlled. Thus, the circuit has the capability of providing a steady amber light in addition to a steady red light in the event that two valid code pulse trains are received during one cycle of operation of the timer 148. Referring again to flipflops 132 and 134, it will be recalled that the first time that an output is delivered by counter 192, the flipflops are set to a binary count of one, which enabled the timer 148 and set the gate 140 for subsequent operation from the divide by 16 counter 192. If during the operation of timer 148 a second valid signal is detected, flipflops 132 and 134 will assume a count of binary two. When the flipflops have a count of two, NAND gate 200 is enabled and produces an output via line 202, enabling one input of NAND gate 204. Subsequently, the comparator detects a valid code burst producing an output from counter 192 to edge detector 194, gate 204 will be enabled via line 206, thereby to operate the amber light latch 210.

It should be noted that gate 140 when the flipflop counters are in the state of two, is disabled and therefore any signal received from the edge detector 194 can only operate the amber latch 210 and not reactivate the red light latch 142. Since both the red and amber latches are reset by the timer 148 this is not critical, however.

In the situation where a second code pattern is received during operation of the timer 148, both the red and amber lights will come on. This indicates to the drivers of the emergency vehicles that more than one valid code burst has been transmitted to the traffic control signal and that, therefore, extreme caution is advised in going through the intersection since another emergency vehicle may be approaching the same intersection on a cross street.

A second significant problem with emergency control systems such as the present invention is the possibility that a given intersection is red at the time that an emergency vehicle is approaching it but that for some reason the transmitted code burst was not received and correctly identified by the traffic control signal. In such a situation, absent a test circuit, the driver of an emergency vehicle might begin to enter an intersection, at which point the light could change from red to green, or at which time the light might be green in the cross traffic direction, creating a very high possibility of a traffic accident. Accordingly, it is desirable to provide a positive means whereby the driver of an emergency vehicle can determine that the traffic signal is not operating in its normal mode but that it is continuous red in all four directions and that he may safely proceed through the intersection with no danger of being struck by cross traffic. It will be understood that this test procedure now to be described is utilized in the case where the amber light is not activated by latch 210 and thus there is no question of a second emergency vehicle in the vicinity of the traffic signal but only the question of whether the light is in fact under emergency control.

Referring again to the code and gating section 10 of the transmitter, it will be recalled that a test pushbutton 92 is provided which actuates a timer 94 and begins operation of the transmission section of the circuit via gate 44 in a manner identical with operation of pushbutton 40 and timer 42. The output of timer 94, however, is also provided via line 90 to NOR gate 86, and thus when pushbutton 92 is actuated, gate 86 is rendered inoperative since a signal on line 90 inhibits operation of the gate. From the previous description it will be recalled that gate 86 produces the check bit of the transmitted pulse train and thus when gate 86 is inhibited during the test cycle, this check bit is absent.

In the receiver, means are provided for detecting the omission of the last bit, thereby to recognize the transmission of a test code pattern. Transmission and detection of a test code pattern is effective for producing a blinking of the amber light. That is, the amber light is operated via blink timer 217 and NOR gate 208 for a period of time just sufficient to indicate to the operator, in response to his test, that the traffic control signal is indeed under his control. The period of operation is sufficiently short and since the amber latch 210 is not set, no steady amber signal is produced.

If during emergency operation of the traffic signal, the emergency vehicle transmits a test code pattern, the red traffic light remains illuminated while the amber light is blinked on for a period on the order of one second and then extinguished. When a test code is transmitted by the emergency vehicle, it will be detected by the receiver. However, the shift register 170 output will not match the codes preset in comparator 180 by selector switch 190 since the last bit is missing. The test code will, however, match the condition set in comparator 182 which is set for the test code. The output from comparator 182 is coupled via NAND gate 188 to a divide by 16 counter 215 which operates in the same manner as counter 192. When an output is produced by counter 215, the blink timer 217 is enabled via line 214 and gate 212 is energized and will provide a signal via line 216 and gate 208 to the amber light for a short preselected period of time as, for example, 1 second. At the end of the preselected period of time, the blink timer will extinguish the amber light. In the event that a test code is received before a control code, the test gate 212 would not be enabled on line 214, and therefore, the circuit would not respond to the improper test signal.

Figure 4:
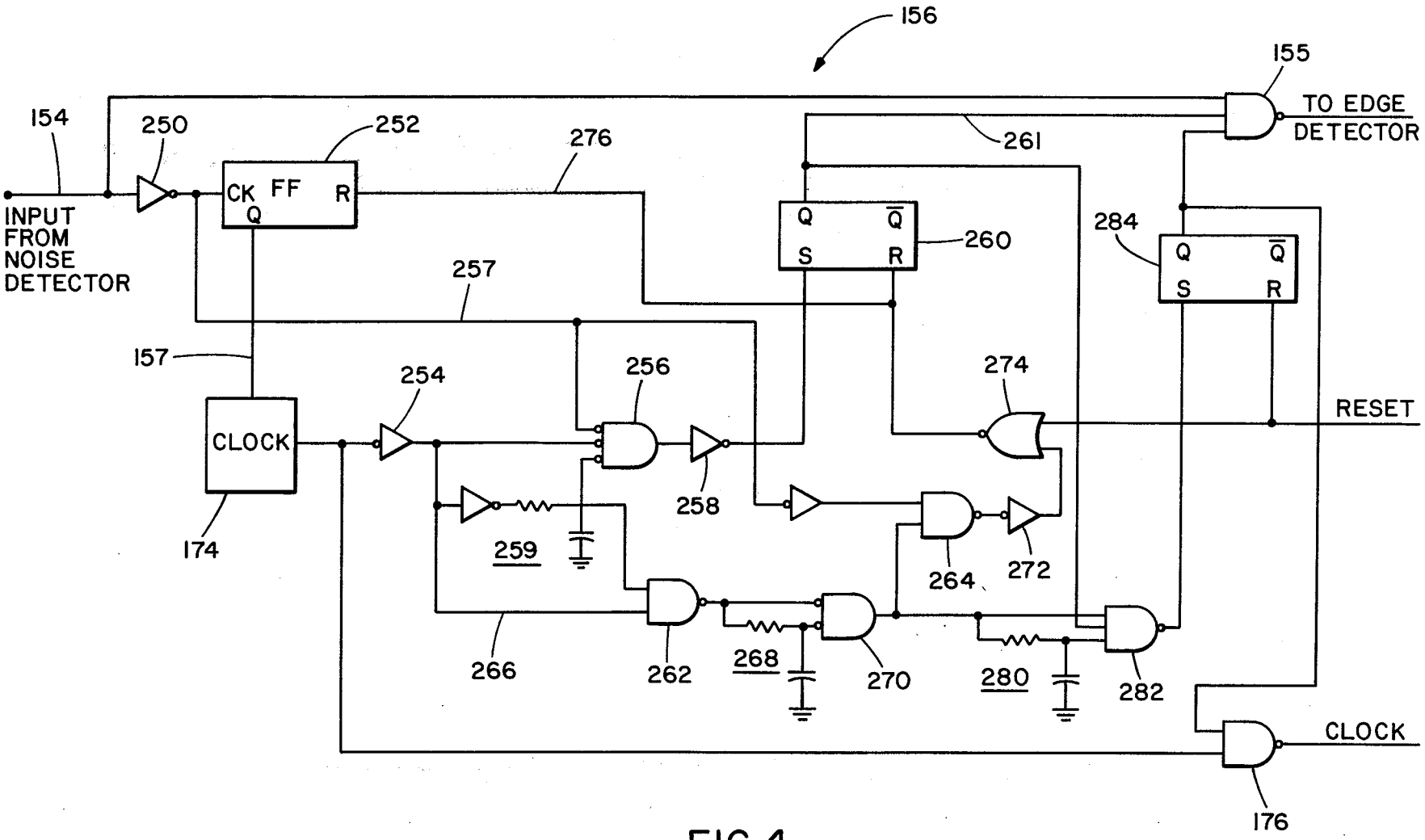
FIG. 4 is a schematic of the sync network of the receiver.

Referring now to FIG. 4, the sync network 156 is described. Sync network 156 is in reality a sync signal detector. This circuit detects the presence of the sync pulse (FIG. 3) by testing the length of a pulse to see if it ends within a selected window. By referring to FIG. 3, it will be seen that sync pulse which precedes the code pulses is of a longer duration and is used for synchronizing the receiver with the transmitter. Until the sync pulse is detected by the sync network 156, the receiver is disabled by gate 155.

As indicated in connection with FIG. 2, after passing the squelch and noise circuits, the received signal is transmitted on line 154 to the sync network. Line 154 is provided to the clock input of flipflop 252 through inverter 250 (on the leading edge of a pulse inverter 250) causing flipflop 252 to be set thereby enabling the clock 174. Initially, clock 174 has a low output which, via an inverter 254, produces a high signal at one input to three input NAND gate 256. Via line 257 the inverted leading edge is applied as a second input to gate 256 while the third input is provided via the RC network 259. RC network 259 and gate 256 constitute a comparator for providing an indication of whether or not the detected signal is of at least a minimum length. At the time when the network 259 enables its input to the gate 256, if the input signal is still present on line 257, gate 256 will produce an output via inverter 258 effective for setting flipflop 260. Setting flipflop 260 enables one input of NAND gate 155 on line 261. As thus far described, it will be apparent that if a signal is of sufficient length to enable gate 256, flipflop 260 enables gate 155 to permit the signal to pass to the receiver comparing section. In effect, the signal is of sufficient length that it may be a sync signal. The balance of the sync network circuit 156 performs a second test to determine that the detected signal is not merely noise by requiring that it be of a preselected maximum length.

The maximum test is accomplished by NAND gate 264 which receives as its input an inverted version of the signal on line 257 and a clock signal via line 266, NAND gate 262 and RC circuit 268. When the inverter 254 goes high on the next half cycle of the clock 174, an output is produced from NAND gate 262 which, after delay by RC network 268, is provided to NAND gate 270. If the input signal on line 257 is still present when gate 270 is enabled, NAND gate 264 is enabled which is effective via inverter 272 and NOR gate 274 for resetting flipflop 260. In effect the pulse is too long to be a proper sync signal; therefore, flipflop 260 is reset to disable NAND gate 155. If a proper sync pulse is detected, it will not be present when gate 270 is enabled and, threfore, gate 264 will not reset flipflop 260. When flipflop 260 is reset, flipflop 252 is also reset via line 276 so that the circuit is ready to test the next pulse received. According to a preferred embodiment of the present invention, NAND gates 256 and 264 in conjunction with the clock 174 have the effect of creating a window which requires that a sync pulse having at least a 50 microsecond to a maximum of 100 microsecond duration be detected before the comparison section of the receiver will be actuated.

If flipflop 260 is not reset, thereby indicating the presence of a proper sync pulse, a final RC network 280 in conjunction with NAND gate 282 and flipflop 284 are provided to delay enabling gate 155 just sufficiently so that the sync pulse passes before enabling the receiver section.

While I have shown and described embodiments of this invention in some detail, it will be understood that this description and illustrations are offered merely by way of example, and that the invention is to be limited in scope only by the appended claims.

I claim:

1. An emergency system for remotely controlling the light latches associated with traffic signal lights comprising:

a. a remotely located transmitter means including:
   i. first and second RF oscillators,
   ii. means for transmitting the signals generated by said oscillators,
   iii. means for generating a binary code,
   iv. logic means for gating the output of said first or second oscillator to said transmitting means according to said code thereby to transmit a binary coded RF signal;

b. means for receiving the binary coded RF signals including:
   i. first means for comparing said coded signal and producing an output indicative of a match,
   ii. means responsive to the output from said first comparison means for enabling a first signal light latch.

2. The device according to claim 1 wherein said transmitting means includes means for generating a test coded RF signal and said receiving means further includes second comparison means for comparing said coded signal and producing an output indicative of a match and means responsive to the output from said second comparison means for enabling a second signal light latch to momentarily blink the light associated therewith.

3. An emergency system for remotely controlling the light latches associated with traffic signal lights comprising:

a. a remotely located transmitter means including:
   i. first and second RF oscillators,
   ii. means for transmitting the signals generated by said oscillators,
   iii. means for generating a binary code,
   iv. logic means for gating the output of said first or second oscillator to said transmitting means according to said code thereby to transmit a binary coded RF signal;

b. means for receiving said coded RF signal including:
   i. means for reproducing said binary code from said RF signal,
   ii. first means for comparing the reproduced binary code against a preset operation code and producing an output indicating a match,
   iii. means for counting the number of times a coded RF signal is received during a preselected interval,
   iv. means responsive to the output from said first comparison means for enabling a first signal light latch if said counting means has a count of one and for enabling an additional light latch if a count of two.

4. The device of claim 3 wherein said transmitter means further includes means for generating a test coded RF signal and said receiving means further includes:

a. second means for comparing the reproduced binary code against a preset test code and producing an output indication of a match;
b. means responsive to the output from said second comparison means for enabling said additional latch to momentarily blink the light associated therewith.

5. The device according to claim 3 wherein said first and second RF oscillators operate at frequencies centered about 30 MHz.

6. The device according to claim 3 wherein said means for generating a binary code includes a code selector switch and a shift register.

* * * * *